United States Patent [19]

Berg

[11] Patent Number: 4,657,476

[45] Date of Patent: Apr. 14, 1987

[54] VARIABLE AREA TURBINE

[75] Inventor: Paul H. Berg, Simi Valley, Calif.

[73] Assignee: Turbotech, Inc., Sepulveda, Calif.

[21] Appl. No.: 599,006

[22] Filed: Apr. 11, 1984

[51] Int. Cl.[4] ..... F01D 9/04; F01D 17/16

[52] U.S. Cl. ..... 415/48; 415/164

[58] Field of Search ..... 415/26, 29, 48, 148, 415/150, 151, 160, 161, 162, 163, 164, 211, 49; 417/407

[56] References Cited

U.S. PATENT DOCUMENTS

| | | | |
|---|---|---|---|
| 2,409,837 | 10/1946 | Alford | 415/26 |
| 2,861,774 | 11/1958 | Buchi | 415/29 X |
| 2,976,013 | 3/1961 | Hunter | 415/163 X |
| 3,799,694 | 3/1974 | Duzan | 415/163 X |
| 4,022,541 | 5/1977 | Perrigo et al. | 415/211 X |
| 4,242,040 | 12/1980 | Swearingen | 415/163 X |
| 4,355,953 | 10/1982 | Nelson | 415/164 |

FOREIGN PATENT DOCUMENTS

| | | | |
|---|---|---|---|
| 224977 | 9/1909 | Fed. Rep. of Germany | 415/163 |

*Primary Examiner*—Robert E. Garrett
*Assistant Examiner*—Joseph M. Pitko
*Attorney, Agent, or Firm*—Poms, Smith, Lande & Rose

[57] ABSTRACT

Exhaust gas turbine for driving a charging compressor for an internal combustion engine has movable inlet vanes. The vanes are controlled by sensing the inlet and outlet pressure at the vanes and adjusting the vanes in accordance with these pressures in order to maximize turbine efficiency.

17 Claims, 5 Drawing Figures

FIG. 3
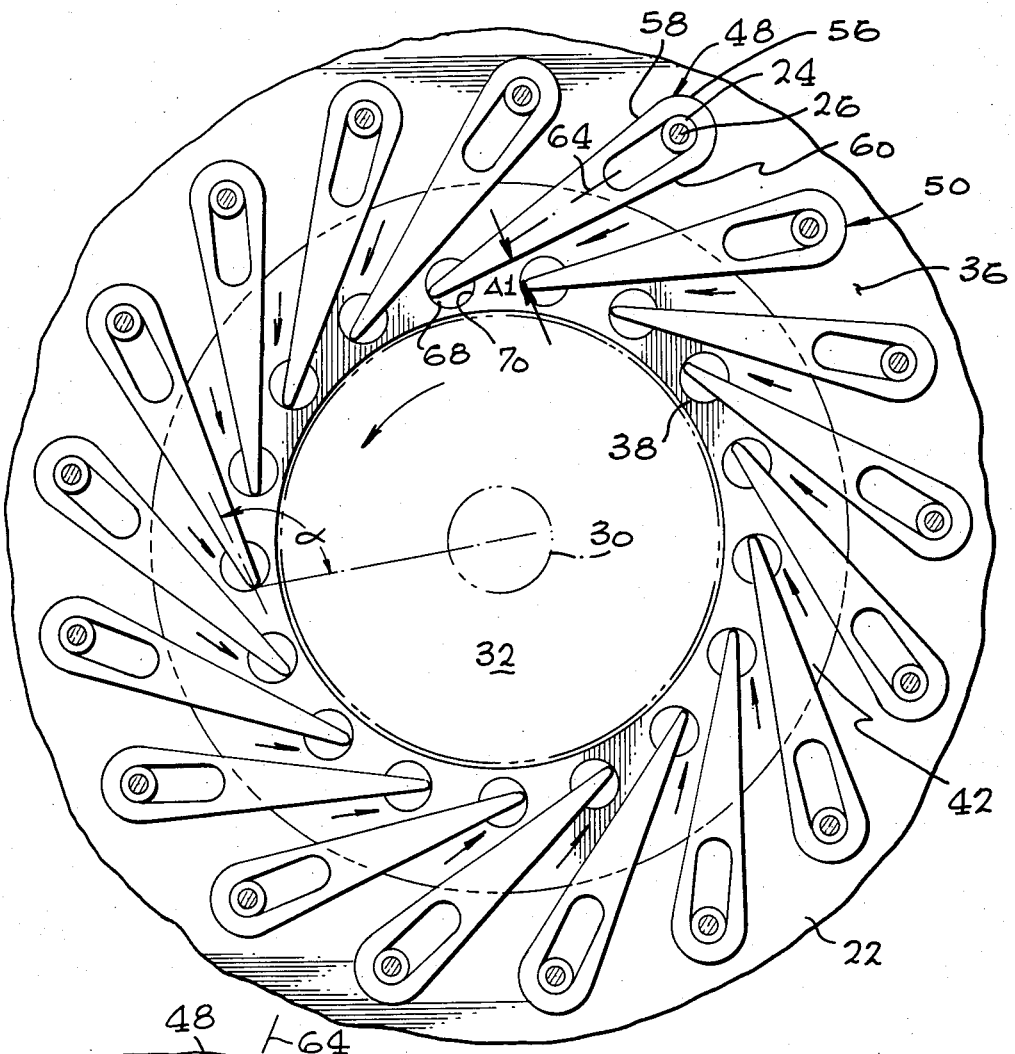
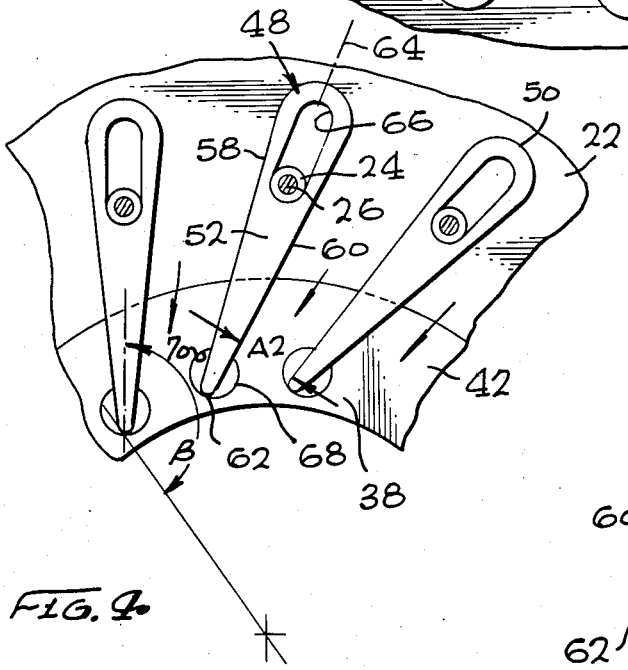
FIG. 4
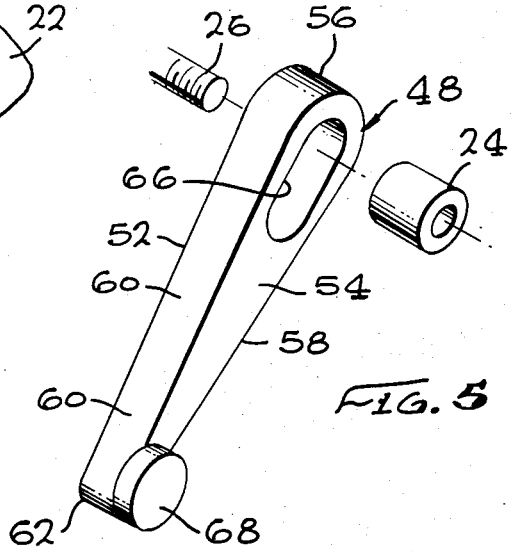
FIG. 5

VARIABLE AREA TURBINE

BACKGROUND OF THE INVENTION

This invention is directed to an exhaust gas turbine with movable vanes wherein pressure is sensed at the inlet and outlet of the vanes to control the vanes for adjusting their angle and nozzle openings to maximize efficiency.

Modern internal combustion engines can supply greater output power when their cylinders are charged with more air through the use of a charging compressor, along with a corresponding increased supply of fuel. A centrifugal compressor is often used for this purpose and an exhaust gas turbine drives the charging compressor current. Commercially available turbochargers are of a type where the housing directing the exhaust gas to the turbine is of the open volute type which has a fixed entrance area. Such fixed area housings do not provide optimum efficiency over the turbine operating range. This is because the operating conditions diverge from the optimum conditions for which that turbine was designed. At low engine speed, the turbine requires smaller inlet area, while the large exhaust gas flow at high engine rpm requires a large inlet area. Hence, the fixed housing inlet area designs of current commercial turbochargers have design compromises causing poor transient response time (turbo-lag), poor fuel economy, high exhaust manifold pressures at high and low engine rpm, and severe detonation in gasoline fueled engines under some operating conditions.

SUMMARY OF THE INVENTION

In order to aid in the understanding of this invention, it can be stated in essentially summary form that it is directed to a variable area hot gas turbine and system wherein the nozzle openings are formed between movable vanes. The hot gas pressure into and out of the vanes is measured and is used to control the vane angle and nozzle opening between the vanes to provide more optimum turbine operating conditions for increased turbine efficiency.

It is, thus, an object and advantage of this invention to provide a variable nozzle area in a hot gas turbine by moving vanes which define the nozzle area to change both the nozzle angle and nozzle opening area in accordance with sensed system pressures.

It is a further object and advantage of this invention to provide a hot gas turbine which has a plurality of vanes which define nozzle openings, with the vanes mounted to move together to control the nozzle area to increase operating efficiency.

It is another object and advantage of this invention to provide a hot gas turbine operating system wherein the inlet and outlet pressure of the turbine nozzles is sensed and the nozzle area is determined as a function of these pressures to provide optimum turbine operating conditions for improved turbine operating efficiency.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 3 is a section taken generally along the line 3—3 of FIG. 2, with parts broken away, showing the movable vanes in a position of minimum nozzle area.

FIG. 4 is a partial view similar to FIG. 3, with parts broken away, showing the vanes in a position of maximum nozzle area.

FIG. 5 is an isometric view of one of the vanes shown in exploded position with respect to its mounting pin and mounting bolt.

DESCRIPTION OF THE PREFERRED EMBODIMENT

Figure 1:
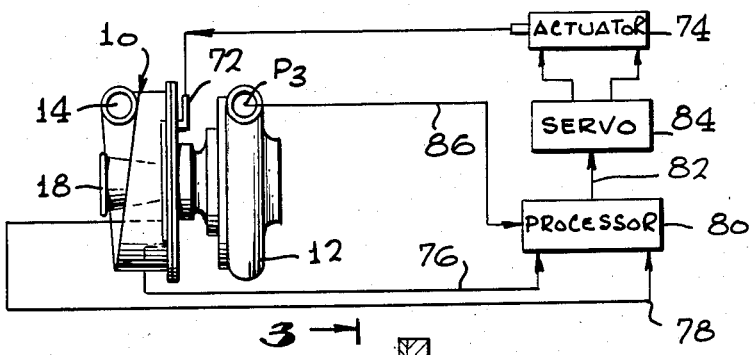
FIG. 1 is a plan view of the variable area turbine of this invention, shown driving a charging compressor and shown as being controlled by a system in accordance with this invention.
Figure 2:
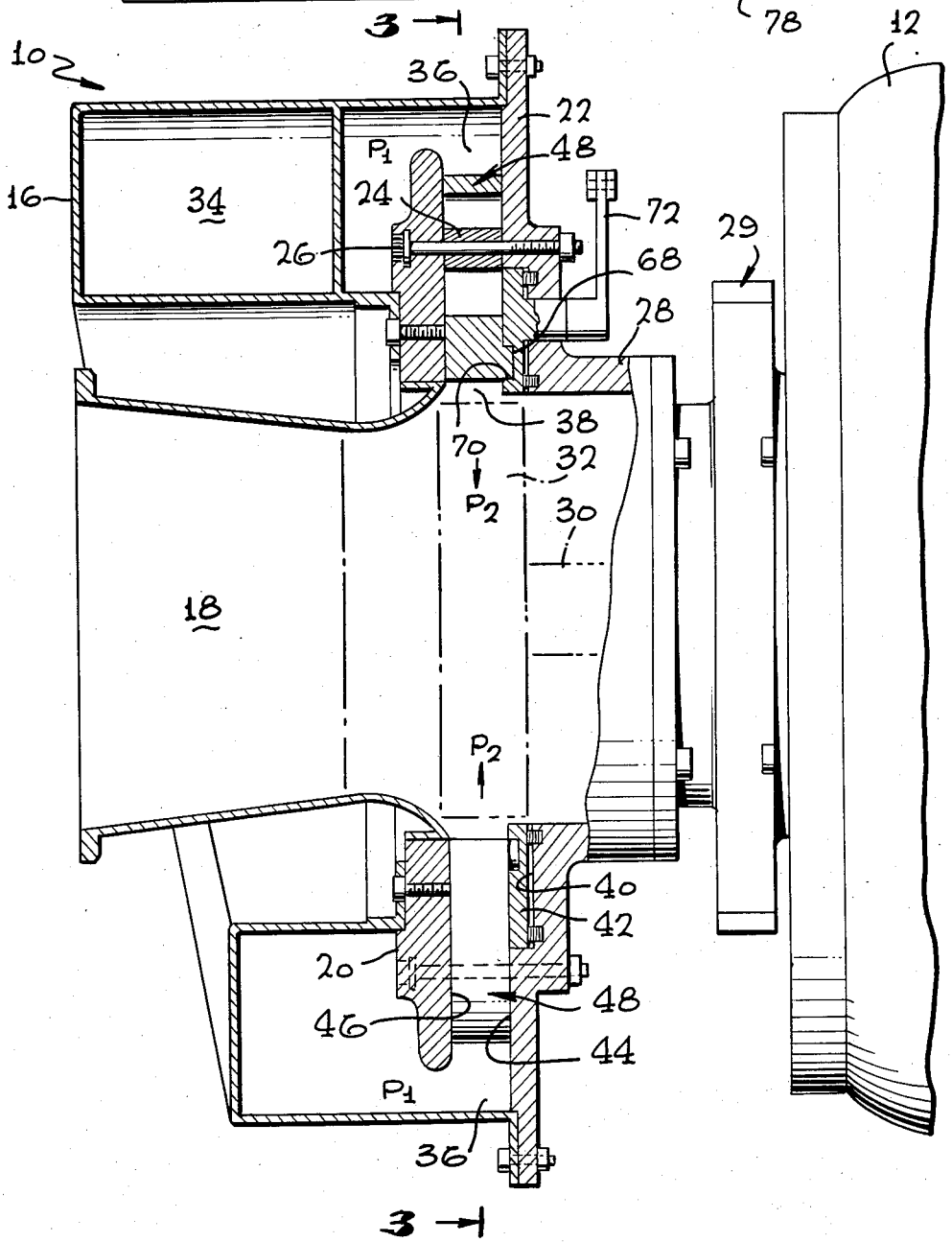
FIG. 2 is a center line section through the variable area turbine of this invention.

The variable area turbine of this invention is indicated at 10 and is illustrated in plan in FIG. 1 and in section in FIG. 2. In FIGS. 1 and 2, it is illustrated as being mechanically coupled to charging compressor 12 which serves as the load on the turbine. While the turbine is useful in driving many different types of mechanical load, it is illustrated as driving the charging compressor 12 because that is an often used device which is driven by such turbines. Hot gas inlet 14 is provided for connection and delivery of hot gas under pressure into the scroll inlet housing 16, see FIG. 2. Exhaust bell 18 receives the exhaust from the turbine for downstream discharge.

Main ring 20 is one of the main structural elements of the turbine 10. Housing 16 and exhaust bell 18 are both mounted on this ring. Frame ring 22 is the other main structural element of the turbine. The rings are spaced from each other and secured to each other by means of a plurality of circular tubular spacers positioned and clamed therebetween. Spacer 24 is shown in FIGS. 2, 3, 4 and 5. Bolt 26 extends through the spacer and engages upon both rings to clamp the rings together. Boss 28 on frame ring 22 permits the mounting of turbine 10 with respect to the adjacent machinery, such as charging compressor 12. As illustrated, bearing capsule 29 is mounted on boss 28 and provides bearings which rotatably carry turbine shaft 30. Turbine wheel 32 is mounted on the turbine shaft 30. It is the conversion of the pressurized hot gas flow into kinetic energy in this turbine wheel which produces the mechanical power.

As is best seen in FIG. 2, inlet gas is delivered from inlet or engine exhaust chamber 34 to the inlet region 36 just before the gas passes between the rings in which are located the nozzles. Inlet or engine exhaust or manifold pressure $P_1$ is measured at the inlet region 36 by any conventional means. Outlet pressure $P_2$ from the nozzles is measured at the nozzle outlet region 38 which is located downstream from the nozzles and before the gas from the nozzles enters the turbine wheel 32.

Frame ring 22 has an annular groove 40 therein in which lies control ring 42. The surface of control ring 42 lies in the same plane as the surface 44 of frame ring 22. Control ring 42 is rotatable in its groove around an axis which is the same as the axis of rotation of shaft 30 and its turbine wheel 32. The same axis lies through the center of exhaust bell 18. The surface 46 of main ring 20 is also planar, parallel to surface 44 and normal to the central axis. As previously described, the spacers 24 engage upon these surfaces and maintain the rings spaced apart in parallel planes.

A plurality of identical vanes are positioned between the rings. Vane 48 is illustrated in FIGS. 2, 3, 4 and 5 and its adjacent vane 50 is shown in FIGS. 3 and 4. Each of the vanes is identical, and the vanes extend around the annular space defined between rings 20 and 22. As seen in FIG. 3, the number of vanes 50 equal the prime number 17.

As is best seen in FIG. 5, vane 48 has an elongated body which is almost as thick as the space between surfaces 44 and 46. The thickness is measured between the top 52 and bottom 54 of vane 48. Vane 48 has a hemi-cylindrical nose 56 which is normal to the top and bottom surfaces. The right and left sides 58 and 60 are planar and extend from tangencies with the nose to point 62. Point 62 is not quite sharp, but is also a hemi-cylindrical surface of much smaller diameter than nose 56. The vane 48 is symmetrical about center line plane 64.

Slot 66 is formed through the vane. Slot 66 is an elongated slot along the central plane and has rounded ends. The slot is sized to receive spacer 24 and to permit relative motion of the spacer along the length of the slot. On the other end of the vane, away from the slot, circular boss 68 is formed to extend below the bottom 54 of the vane. Note in FIGS. 3–5 that point 32 may be aligned with the circumferential edge of the circular boss 68. However, this is not necessary. Control ring 42 has a series of circular recesses to receive the bosses of the several vanes, and boss 68 extends into recess 70 in the control ring.

The facing sides of adjacent vanes form the nozzles through which the hot gas is directed onto the turbine wheel. By rotating control ring 42, both the angle of the vanes with respect to the turbine wheel and the nozzle opening can be controlled. As shown in FIG. 3, control ring 42 is rotated into its counter-clockwise limit position where the vane is stopped by the outer end of slot 66 engaging against spacer 24. In this position, the area of each nozzle is A1, which is the minimum distance between the nozzle faces, as seen in FIG. 3, times the distance between faces 44 and 46. The vane angle with respect to a reference is alpha. When control ring 42 is rotated in the opposite limit position, as shown in FIG. 4, the vane is stopped by the other end of slot 66 engaging against spacer 24. In this position, the vane angle with respect to the same reference is beta, while the nozzle area is A2. Thus, by rotating the control ring, the nozzle area and the nozzle angle with respect to the turbine wheel can be varied.

Control arm 72, see FIGS. 1 and 2, is attached to control ring 42 and extends out from frame ring 22 in order to be physically accessible. As is seen in FIG. 1, actuator 74, which may be an electric solenoid or hydraulic cylinder, for example, is connected as by a cable to move the control arm 72 and thus the control ring 42 to adjust the nozzle area and angle. The inlet pressure P1 in inlet region 36 is sensed and a signal representing that pressure is transmitted in line 76. The outlet pressure P2 is sensed in the outlet region 38 and a signal representing that pressure is transmitted in line 78. The two lines 76 and 78 are connected to signal processor 80 which operates on a suitable aglorithm to provide a signal which corresponds to the desired nozzle area and vane angle. That signal is transmitted by line 82 to serve-amplifier 84 which drives actuator 74. The actuator 74 may have feedback to the servo-amplifier 84.

In some cases, as with centrifugal compressors, a condition known as "compressor surge" occurs wherein there are undesirable pressure fluctuations which, if graphed, would appear somewhat like a pressure ripple. The incipient surge condition can be detected by a pressure sensor which monitors the compressor pressure P3, as indicated in FIG. 1. The sensed compressor pressure P3 produces a signal which is transmitted in line 86 to signal processor 80. The operational algorithm of processor 80 includes suitable factors to accommodate the P3 data and provide a signal to servo 84 for thus modifying the nozzle area and vane angle so as to prevent the surge occurrence.

The nozzles are formed between a selected, prime number of individual vanes. The adjacent walls of the vanes comprise the convergent hot gas passages or nozzles. In these nozzles, the energy conversion takes place. The gases in the inlet housing 16 are at high pressure and at low velocity. In the nozzles, the gas is converted to low pressure, high velocity gas. Due to the conversion, the pressure energy has been converted to kinetic energy. The high velocity gas impinges upon the turbine wheel 32 to produce torque. Signal processor 80 provides an adjustable characteristic output that follows a predetermined curve which has previously been empirically determined to be the optimum relationship of the nozzle angle and area for the operating characteristics of the exhaust gas turbine as related to its hot gas pressure and work load. This system achieves the proper energy conversion by utilization of the variable geometry of the nozzle structure and is based on the particular operating conditions at the inlet and outlet of the nozzles and the compressor. By utilizing the turbine nozzle inlet and outlet pressures and the compressor characteristics, the optimum nozzle opening is selected to provide maximum energy conversion to kinetic energy and maximum kinetic energy transfer to the turbine wheel. When the turbine system is employed as an exhaust gas driven turbocharger for an internal combustion engine, even with low engine rpm and low exhaust gas flow, the nozzle opening is selected to achieve highest transfer of energy from the high pressure gas at the nozzle inlet to high velocity gas at the nozzle output which provides high kinetic energy for producing high turbine rotor speed. At higher engine speed and higher exhaust gas flow, the nozzles are opened to decrease the nozzle inlet-to-outlet velocity ratio. This provides a lower gas velocity at the nozzle exit. As a result of this lower velocity, more energy is available for the reactive stage of the turbine to maintain high energy conversion to the mechanical system. The overall efficiency of the turbine is improved, and the larger nozzle openings at high exhaust gas flow results in lower engine exhaust manifold pressure and lower engine pumping loss. These improvements result in lower specific fuel consumption over a wide range of operating conditions.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A variable area hot gas turbine comprising:

a frame;

a turbine shaft rotatably mounted in said frame;

a turbine wheel secured to said turbine shaft;

a pair of parallel plates forming a hot gas inlet positioned with respect to said turbine wheel so that hot gas delivered through said hot gas inlet to said turbine wheel turns said turbine wheel and said turbine shaft;

vanes mounted in said hot gas inlet to form nozzles, each nozzle being formed as the space between said parallel plates and adjacent vanes;

each of said vanes having a longitudinal slot therein and having a pivot boss mounted at the trailing edge thereof closest to said turbine wheel;

a control ring rotatably mounted upon one of said pair of parallel plates around the axis of said turbine shaft, said pivot bosses being pivotally mounted on said control ring so that rotation of said ring moves said pivot bosses of said vane in a circular path and said vane in a generally longitudinal direction;

said slot constrains motion of said vane in said longitudinal direction so that upon rotation of said control ring both the distance between adjacent vanes and the relative angle between adjacent vanes is controlled.

2. The hot gas turbine of claim 1 additionally comprising:

said pair of parallel plates include a main ring and a frame ring, pins mounted on said main and frame rings, and said slots in said vanes embracing said pins to control the motion of said vanes.

3. The hot gas turbine of claim 2 wherein each of said vanes has a nose end adjacent the end of said vane away from said turbine wheel and said slot is adjacent said nose end of said vane, said slot extending generally longitudinally of said vane away from said nose end.

4. The hot gas turbine of claim 3 wherein said vane decreases in thickness from said nose end toward said pivot with the smallest thickness of said vane mounted upon said pivot boss.

5. The hot gas turbine of claim 4 wherein said pivot boss on said vane is a circular boss thereon, said circular boss fits within a circular recess within said control ring, and said trailing edge of said vane is aligned with the circumferential edge of said circular boss.

6. The hot gas turbine of claim 5 additionally comprising:

pressure sensors positioned to sense inlet pressure at the nose end of said vane and to sense nozzle pressure adjacent the pivot end of said vane, means for transmitting signals corresponding to such inlet pressure and nozzle pressure, a signal processor, said means for transmitting connected to said signal processor, an actuator connected to be driven by said signal processor, said actuator being connected to said control ring to adjust said vanes in accordance with such inlet pressure and nozzle pressure.

7. The hot gas turbine of claim 6 further comprising:

a gas compressor connected in series with said turbine, a compressor pressure sensor positioned to sense gas pressure in said compressor and provide a compressor signal output, means transmitting said compressor signal output to said signal processor so that said vanes are adjusted in accordance with such compressor gas pressure to prevent compressor surge.

8. A hot gas turbine comprising:

a turbine wheel rotatably mounted upon an axis;

a frame ring which is substantially circular around said axis and has a planar surface normal to said axis;

a main ring positioned around said axis, said main ring having a planar surface substantially normal to said axis and facing said surface of said frame ring;

a plurality of spacers between said surfaces to hold said surfaces apart a fixed distance to define an annular hot gas passage radially outward from said turbine wheel;

a plurality of movable vanes between said rings, each of said vanes having a slot therein, with said vanes embracing said spacers with said spacers within said slots in said vanes, each of said vanes having a nose on the radially outward end of each vane and having a point on the inward end of each vane, said slot being adjacent said nose end of said vane and being directed toward said point end of said vane;

an annular groove in one of said rings, a control ring rotatably mounted in said annular groove, said control ring lying in line with said surface of said ring, a pivot boss on each of said movable vanes adjacent said point end of said vane, a recess in said ring, said pivot boss engaging in said recess so that rotation of said control ring causes circular motion of said pivot boss and a substantially longitudinal sliding motion of said vane on said spacer over said surfaces to control the nozzle spacing adjacent said movable vane and control the angle of said movable vane.

9. The hot gas turbine of claim 8 wherein:

said vanes include a prime number of said vanes.

10. The hot gas turbine of claim 8, additionally comprising:

inlet pressure-sensing means adjacent said nose of said vane and nozzle outlet pressure-sensing means adjacent the point end of said vane for supplying pressure signals at those locations, a signal processor connected to receive pressure signals from those locations and an actuator connected to said ring and to said signal processor for moving said control ring in said vanes in accordance with the pressures at those locations.

11. The hot gas turbine of claim 10 additionally comprising:

a gas compressor connected in series with said turbine, a compressor pressure sensor positioned to sense gas pressure in said compressor and provide a compressor signal output, means transmitting said compressor signal output to said signal processor so that said vanes are adjusted in accordance with such compressor gas pressure to prevent compressor surge.

12. The hot gas turbine of claim 10, wherein:

said inlet pressure-serving means senses the hot gas pressure of an engine exhaust at its manifold pressure.

13. The hot gas turbine of claim 8, wherein:

said pivot boss on each of said vanes is arranged to mount said point of said vane within the boss area thereof.

14. The hot gas turbine of claim 13, wherein:

said point of said vane is a small semi-cylindrical surface, and said pivot boss is a cylindrical surface whose circumferential edge is aligned with the circumferential edge of said semicylindrical surface of said vane point.

15. In a variable area turbine system having a turbine wheel driven by hot gas including a plurality of nozzles formed by a pair of substantially parallel plates with vanes mounted between the surface of said plates about said turbine wheel, said vanes having a nose end which tapers toward a trailing point at the end thereof closest to said turbine wheel, the improvement comprising:

each of said vanes having a pivot boss mounting at said trailing point;

one of said substantially parallel plates having an annular groove in said surface;

a control ring rotatably mounted in said groove to lie in line with said surface of one of said substantially parallel plates to receive said vane pivot bosses; and means for rotating said control ring to move said vanes in a substantially linear direction for adjusting the area of said nozzles.

16. In a variable area turbine system, as claimed in claim 15, additionally comprising:

said control ring having an inner edge mounted adjacent said turbine wheel; and each of said vane pivot bosses mounted within said control ring to position said trailing vane points substantially the same distance from said turbine wheel during adjustment thereof by said rotation of control ring.

17. In a variable area turbine system, as claimed in claim 15, additionally comprising:

spacers mounted between said substantially parallel plates to establish the space therebetween;

said vanes having slots therein adjacent said nose ends thereof enclosing said spacers;

said spacers enclosed by said slots limiting said motion of said vanes while permitting said vanes to move substantially linearly along the longitudinal axis therefor to reduce friction caused by said motion.

* * * * *